US006375759B1

(12) United States Patent
Christenson et al.

(10) Patent No.: US 6,375,759 B1
(45) Date of Patent: Apr. 23, 2002

(54) BATCH FABRICATION OF PRECISION MINIATURE PERMANENT MAGNETS

(75) Inventors: Todd R. Christenson; Terry J. Garino; Eugene L. Venturini, all of Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 09/452,321

(22) Filed: Nov. 30, 1999

(51) Int. Cl.[7] ..... H01F 1/053

(52) U.S. Cl. ..... 148/104; 148/103; 214/219

(58) Field of Search ..... 148/104, 101, 148/108, 103; 264/219

(56) References Cited

U.S. PATENT DOCUMENTS 4,765,848 A * 8/1988 Mohri et al. ..... 148/302

* cited by examiner

*Primary Examiner*—John Sheehan
(74) *Attorney, Agent, or Firm*—Brian W. Dodson

(57) ABSTRACT

A new class of processes for fabrication of precision miniature rare earth permanent magnets is disclosed. Such magnets typically have sizes in the range 0.1 to 10 millimeters, and dimensional tolerances as small as one micron. Very large magnetic fields can be produced by such magnets, lending to their potential application in MEMS and related electromechanical applications, and in miniature millimeter-wave vacuum tubes. This abstract contains simplifications, and is supplied only for purposes of searching, not to limit or alter the scope or meaning of any claims herein.

23 Claims, 5 Drawing Sheets

BATCH FABRICATION OF PRECISION MINIATURE PERMANENT MAGNETS

This invention was made with Government support under Contract DE-AC04-94DP85000 awarded by the U.S. Department of Energy. The Government has certain rights in the invention.

BACKGROUND

The present invention relates generally to permanent magnets, and more specifically to a new process for making miniature (typically 0.1 to 10 millimeter) rare earth permanent magnets with dimensional tolerances as small as one micron.

SUMMARY OF THE INVENTION

The present invention relates to new processes for fabrication of precision miniature rare earth permanent magnets, and to the magnets so fabricated. Typical magnet dimensions for the processes disclosed range from about 0.1 to 10 millimeters, while dimensional tolerances as small as one micron can be attained.

BRIEF DESCRIPTION OF THE FIGURES

FIG. 5 schematically shows various techniques which can be used to fill a mold with a flowable molding substance.

DEFINITIONS

Figure 1A:
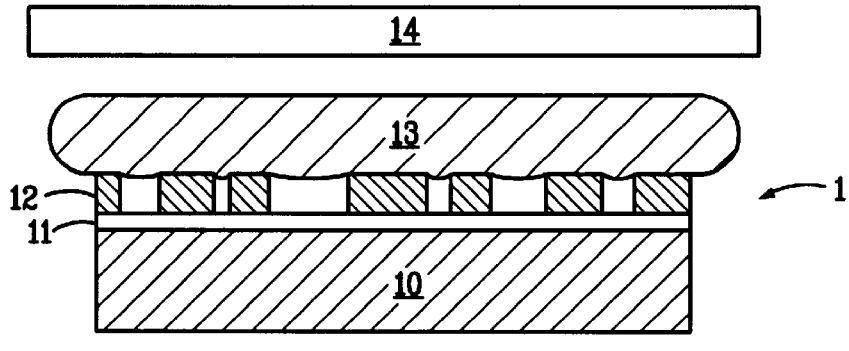
FIG. 1 schematically illustrates an implementation of the class of processes comprising the instant invention.
Figure 1B:
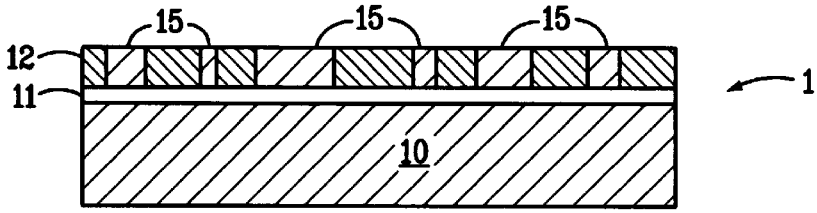

Principal plane—a plane parallel to that of the substrate on which a component is fabricated.

Miniature component—a component which has dimensions in the principal plane roughly in the range 0.1 to 10 millimeters, and dimensions parallel to the principal plane roughly in the range 10 to 1000 microns.

Precision component—a component which has dimensional tolerances roughly in the range 1 to 50 microns in the principal plane, and in the range 0.1 to 10 microns parallel to the principal plane.

2.5 dimensional object—an object which may have a complex outline in the principal plane, but is of substantially constant thickness perpendicular to the principal plane. An object which is stepped to show different outlines on several planes, all of which are parallel to the principal plane, is also a 2.5 dimensional object.

DETAILED DESCRIPTION

The present invention is of a process for fabricating precision miniature magnetic components comprising rare earth magnetic materials, and the components made thereby. Such magnets can exhibit very large magnetic energy products and micron-scale dimensional tolerances. Various implementations of the basic process are described below.

However, the details of the specific implementations chosen are not intended to limit the scope of the invention.

A schematic illustration of the present process is shown in FIG. 1. FIG. 1*a* shows a mold 1, comprising a structured polymer layer 12 attached by a sacrificial layer 11 to a substrate 10. A layer 13 of flowable magnetic material comprising rare-earth magnetic particles is applied to the opposite surface of structured polymer layer 12, and the whole is positioned within a pressing plate 14. The structured polymer layer 12 is often made of polymethamethacrylate (PMMA), and can be structured using various lithographic techniques.

At this point, the pressing plate 14 is lowered, forcing the flowable magnetic material 13 into mold 1. In some implementations, the flowable magnetic material 13 is now caused to solidify, for example by curing an epoxy constituent thereof. After the material is solidified, the voids of mold 1 are accurately filled with the solidified magnetic material, but an uncontrolled amount of excess solidified magnetic material remains on top of mold 1. This leads to the step shown in FIG. 1*b*, where the excess material is lapped off, leading to magnetic components 15, still positioned within mold 1, with precision mechanical tolerances.

Figure 1C:
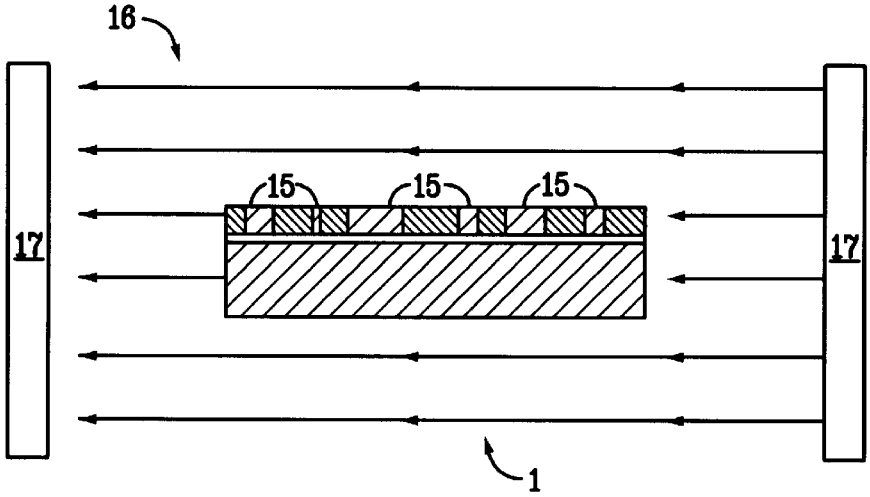
Figure 1D:
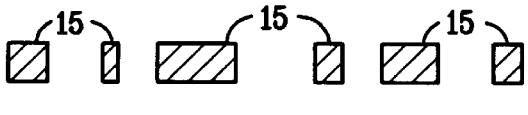

It is now necessary to magnetize, or at least align, the rare earth particles so that the magnetic components 15 have a macroscopic magnetic moment, and thereby generate a large macroscopic magnetic field. (Note that the field direction can vary throughout a given component if the magnetization procedure is appropriately chosen.) This step is shown in FIG. 1*c*, where a large magnetic field 16 is applied to the magnetic components 15 by an external magnet 17. External magnet 17 may function in a pulsed mode to allow sufficiently large magnetic fields to be attained.

If the magnetic components 15 are not intended to be used in place, they are then released from mold 1 (FIG. 1*d*) by dissolving the sacrificial layer 11 and the structured polymer layer 12. The resulting components can exhibit magnetic energy densities as large as 20 megagauss-Oersteds, roughly half that of a fully dense rare earth magnet.

There is a wide class of processes along the lines of that outlined briefly above that are within the scope of the present invention. At nearly every step mentioned above, there can be a fork leading to one or several alternate process routes. Many of these alternate paths will be described below.

The fragility and brittleness of rare earth magnetic materials makes conventional fabrication of precision miniature rare earth magnets impractical. The present invention avoids such limitations, partially by new precision mold fabrication techniques, and partially by new combinations of process steps.

If precision miniature magnetic components are to be fabricated as shown in FIG. 1, the first challenge is to create suitable molds. This is carried out lithographically in the present invention, conventional machining techniques being either inadequate or too expensive for fabrication to the dimensional tolerances required.

Figure 2A:
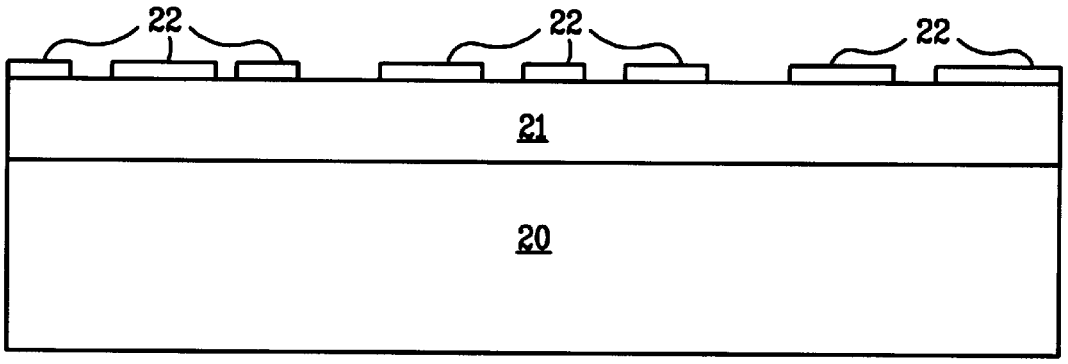
FIG. 2 schematically illustrates an implementation of the process of making polymer molds using precision high aspect ratio lithography.

A variety of lithographic techniques can be applied to the problem of defining the molds. A class of examples are provided by high aspect ratio lithographic techniques, one example of which is the basis for the LIGA technique. High aspect ratio lithography is illustrated in FIG. 2. FIG. 2*a* shows a substrate 20 with a layer of a polymeric lithography resist 21. In the techniques to be described this layer can be as thick as several millimeters, compared to the ~10 micron layers more often used in integrated circuit fabrication. A mask 22 is placed on or above the resist layer 21. Mask 22 is made of a high atomic weight material (often gold), so that it can effectively stop radiation.

At this point, the masked resist layer is exposed to a suitable source of energetic radiation. In the LIGA process this radiation is usually soft x-rays generated by a synchrotron, but other sources and wavelengths of photons can be used, as can certain types of particle beams.

Figure 2B:
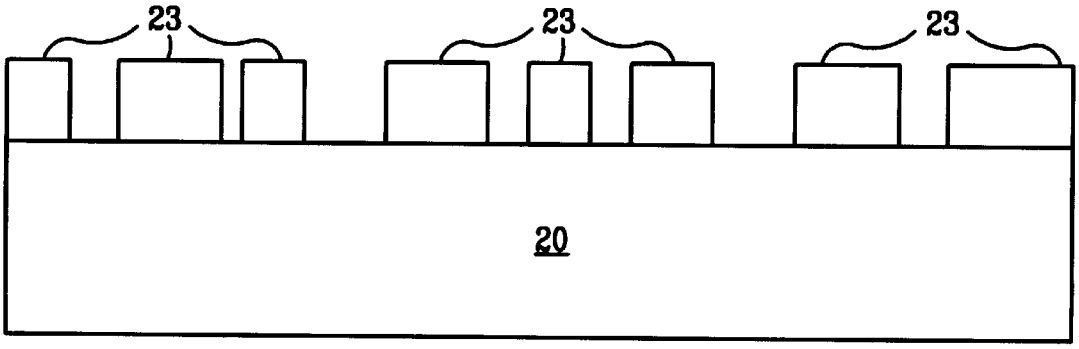

Following the exposure, the exposed resist is dissolved away (if the resist is positive—otherwise the unexposed resist is dissolved away), and the mask 22 is removed. The result, as shown in FIG. 2*b*, is a structured polymer layer 23 resting on a substrate 20. Traditionally PMMA resists are used, but a wide variety of polymeric resists are compatible with this technique.

The precision of the technique depends on being able to accurately replicate the open areas of the mask 22 with exposed resist throughout the thickness of the resist layer. This requires that the radiation source produces a substantially parallel beam, and that neither diffraction from the mask nor diffusion within the resist layer significantly disturbs that beam. The result is tall features with nearly vertical sidewalls, quite suitable for molding 2.5 dimensional objects.

The process outlined in FIG. 2 produces precision miniature structured polymer molds which can exhibit high aspect ratios. However, a polymer-based mold is not suited to fabrication of certain classes of magnetic components. It is therefore useful to provide for a variety of types of molds.

Figure 3A:
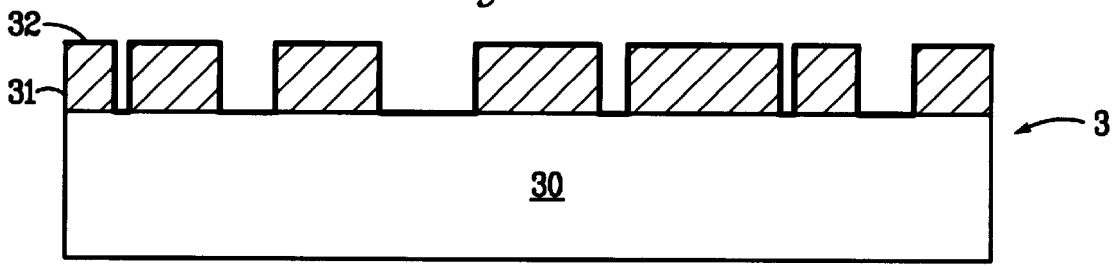
FIG. 3 schematically shows the process of making metal molds.

FIG. 3 outlines the formation of precision miniature metal molds. In FIG. 3*a* one begins with a negative mold 3, comprising a substrate 30 covered by a structured polymer layer 31. The top surfaces of the negative mold 3 are then coated with a release layer 32, which can be dissolved or otherwise removed without damaging the final metal mold. If it is possible to so dissolve the negative mold 3, forming the release layer 32 can be left out of the process.

Figure 3B:
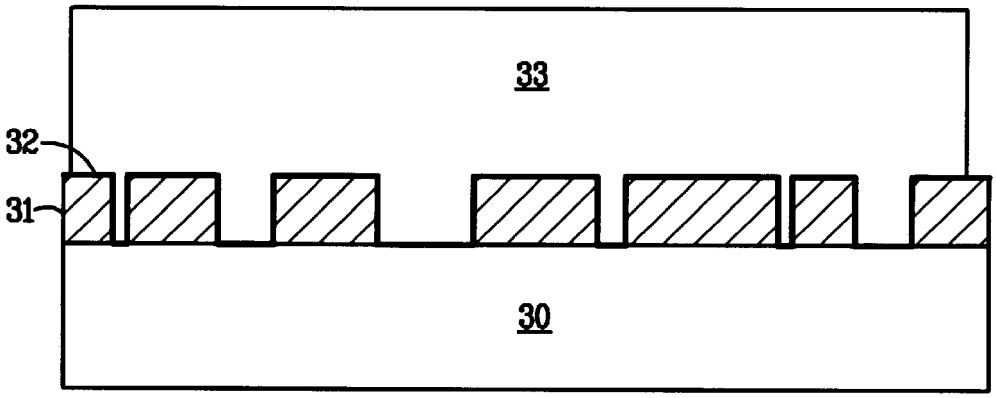

FIG. 3*b* shows the structure attained after a thick layer 33 of metal has been deposited over the release layer 32. There are several possible routes toward depositing metal layer 33. These include electrodeposition onto substrate 30 (requiring that substrate 30 be conducting and that no release layer 32 be deposited), electrodeposition onto release layer 32 (requiring that sacrificial layer 32 be conducting). The above process steps can also be carried out using electroless deposition instead of electrodeposition. Deposition of metal layer 33, or deposition of a conducting release layer 32, or both, can also be carried out using physical deposition of various types, including thermal evaporation and sputtering.

Figure 3C:
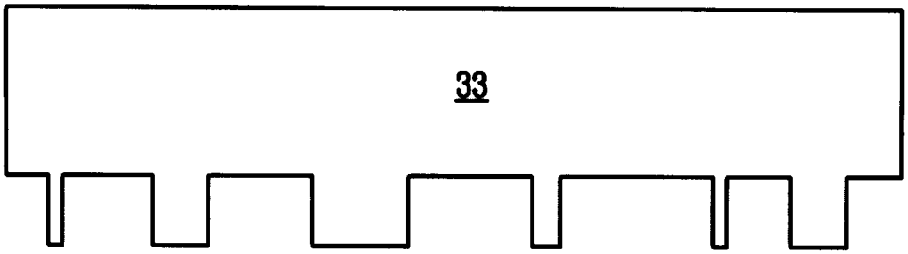

In FIG. 3*c* the negative mold 3 and the release layer 32 have been removed, leaving the final metal mold 33 ready for use. Practical considerations (strength, durability, etc.) can make it appropriate to perform additional tasks, such as lapping flat the back side of metal layer 33, or binding the metal layer to a supporting block (not shown), prior to removing negative mold 3 and release layer 32.

There are also circumstances under which high temperatures will be combined with high pressures. Under such conditions even a metal mold may not prove suited to the task of fabricating precision miniature magnetic components. Ceramic-based molds can often be used to address such problems.

Figure 4A:
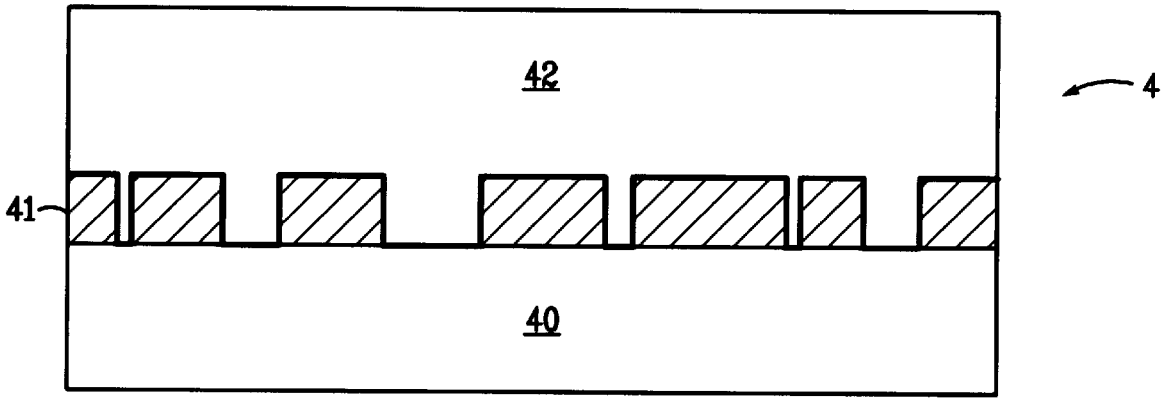
FIG. 4 schematically shows the process of making ceramic molds.
Figure 4B:
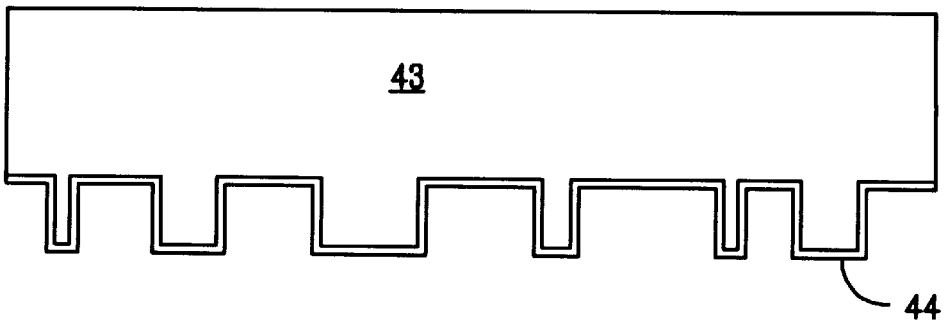

FIG. 4 outlines how a ceramic-based mold can be formed. Such a mold is built upon a negative mold 4 comprising a structured layer 41 on top of a substrate 40. A ceramic precursor layer 42 is applied on top of negative mold 4 so that it thoroughly fills in the voids thereof (FIG. 4*a*). The precursor layer can consist of a ceramic slurry, a pressed ceramic powder (with or without an added binding element), or other formulations known in the art. If the negative mold is not easily removable (for example, during a later firing step), a release layer (not shown) can be introduced between the negative mold and the ceramic precursor layer.

The next step in the process of fabricating a ceramic-based mold involves sintering the ceramic precursor layer. This sintering step is generally carried out under conditions which avoid densification of the ceramic, so that the requisite level of dimensional precision is copied from the negative mold. The sintering can be carried out while the ceramic precursor layer is still in contact with the negative mold, or a preliminary step of stabilizing the ceramic precursor can be carried out, followed by removing the negative mold, then followed by sintering the precursor.

It is also possible, if the negative mold will survive the temperatures and pressures required, to use uniaxial hot pressing to sinter the precursor layer in situ. When this is done, the ceramic can be allowed to fully densify, as the uniaxial pressure will insure that the sintered ceramic fully and accurately fills the voids in the negative mold.

The negative mold can be removed by using a release layer between the ceramic precursor layer and the negative mold, by burning out an organic negative mold, or by other methods known in the art. The result is the ceramic mold 43, shown here with an optional metallic coating 44. Metallic coating 44 can be used as a release layer, or to provide a smoother surface for the subsequent molding operations.

A suitable mold must be filled accurately with a molding substance to produce precision miniature magnetic components. Such a molding compound will comprise rare earth magnetic particles. These particles can individually be magnetized prior to filling the mold, although this is not required to practice the present invention.

A molding compound can consist essentially of such magnetic particles, but can also comprise a dispersion of such particles in a carrier material, or in a binding material, or both. (A carrier material is one which aids the flowability of the magnetic particles, whereas a binding materials is one which enhances the tendency of the magnetic particles to remain in place, either during or after fabrication.) Examples of carrier materials would include entraining gases and fluids.

Several classes of binder materials exist. A binding material can be one that is solid at the intended operational temperatures, but is molten at the time when the mold is being filled. Cooling the mold then solidifies the binding material, fixing the magnetic particles in place.

A binding material can comprise a polymer or other fixing agent dissolved in a solvent. During the process of filling the mold, the magnetic particles are suspended in this solution. Afterwards, the flowable molding substance solidifies when the excess solvent is removed from said substance.

A binding material can comprise a low-order polymer or monomer which is liquid during the step of filing the mold, but in which further polymerization is later initiated, thereby solidifying the substance. Initiation of polymerization can take place through thermal, chemical, or radiation means. In a specific example, the binding material can consist essentially of an uncured epoxy resin.

A wide variety of techniques for filling a mold with a flowable molding substance exist, some of which are illustrated schematically in FIG. 5. In all cases the arrow indicates the direction of motion of the mold.

Figure 5A:
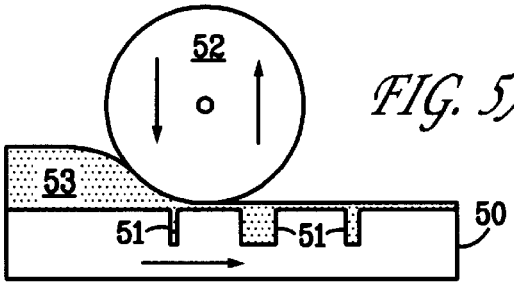
FIG. 5*a* shows a calendering process.
Figure 5B:
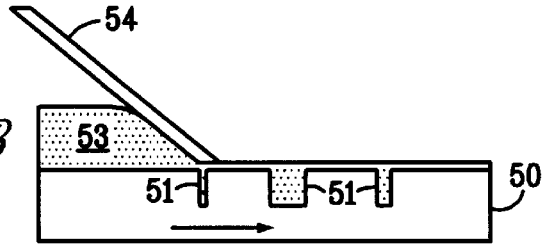
FIG. 5*b* shows a doctor blading process.

FIG. 5*a* shows a calendering process, in which the flowable material 53 is forced into the voids 51 of the mold 50 through the action of pressing roller 52. FIG. 5*b* shows a doctor blading process, in which flowable material 53 is forced into the voids 51 of the mold 50 through the action of doctor blade 54.

Figure 5C:
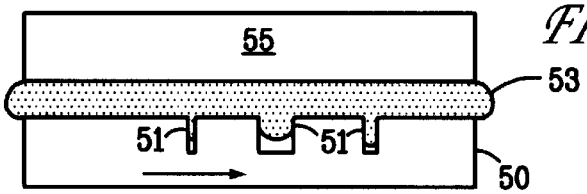
FIG. 5*c* shows a pressing process.

FIG. 5*c* shows a pressing process, in which the flowable material 53 is forced into the voids 51 of the mold 50 through the action of pressing p late 55, which moves toward the upper surface of the mold. The mold and/or the plate can be heated. Such hot pressing often results in stronger final components.

Figure 5D:
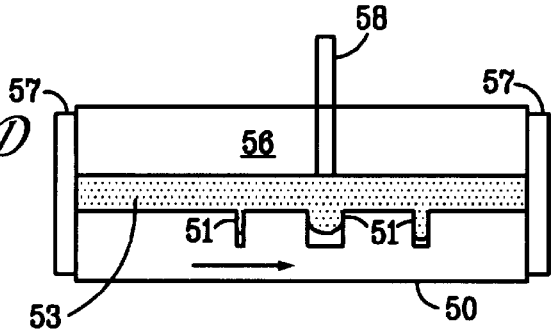
FIG. 5*d* shows an injection molding process.

FIG. 5*d* shows an injection molding process, in which the flowable material 53 is forced into the voids 51 of the mold 50 through the action of injection of flowable material through injection port 58. The injected material is contained by the combined action of mold 50 and elements 56 and 57. Means to allow trapped gases to escape are usually included in the mold design in a variety of ways known in the art (not shown).

Figure 5E:
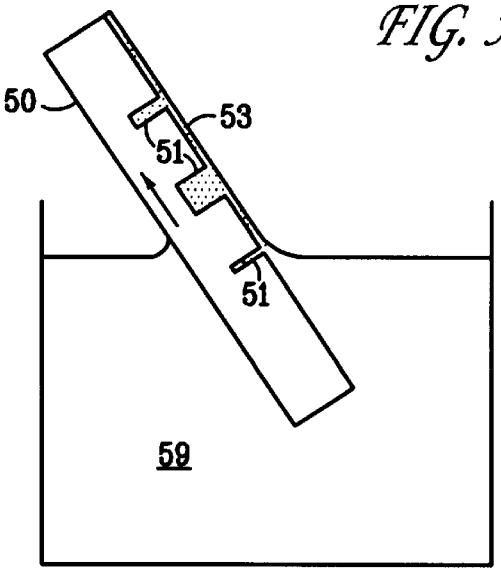
FIG. 5*e* shows a dipping process.

FIG. 5*e* shows a dipping process, wherein the flowable material 53 is forced into the voids 51 of the mold 50 by surface tension and capillary action as the mold is withdrawn from a bath 59 of said flowable material. This technique is usually reserved for thin layers of low-viscosity flowable materials.

Once the mold has been filled and solidified (as described above), excellent dimensional tolerances perpendicular to the principal plane can be obtained by lapping the top surface of the mold. Other means of surface finishing can also be used, such as milling, sanding, planing, and the like.

There are several ways of inducing a macroscopic magnetization in a magnetic component. If the individual magnetic particles are magnetized prior to filling the mold, they can be physically rotated toward a common magnetic orientation by applying an external magnetic field to the mold prior to solidification of the molding substance. It is also possible to reorient the magnetization vector of the individual particles after solidification using an external magnetic field. The magnetic particles can also be given their magnetization using an external magnetic field, even if the magnetic particles are not previously magnetized. It is also possible to provide different portions of a given magnetic component according to this invention with different magnetic orientations through the application of strong local fields.

The examples and implementations described above are intended to illustrate various aspects of the present invention, not to limit the scope thereof. The scope of the invention is set by the claims interpreted in view of the specification.

What is claimed is:

1. A process for fabricating precision rare-earth permanent magnets, comprising the steps of:

a) lithographically constructing a mold for manufacturing precision components;

b) filling said mold with a flowable magnetic material comprising rare-earth magnetic particles; and c) applying a magnetic field and inducing a desired magnetization in said flowable magnetic material thereby forming said precision rare-earth permanent magnets.

2. The process of claim 1, wherein the step of constructing said mold comprises:

a) coating a substrate with a polymer layer; and b) forming a structured layer from said polymer layer with high precision aspect ratio lithography by irradiating a portion of said polymer layer and removing the irradiated portion of said polymer layer.

3. The process of claim 2 further including depositing a sacrificial layer between said substrate and said polymer layer.

4. The process of claim 3 further including releasing the permanent magnets from the mold by removing said sacrificial layer and said structured layer.

5. The process of claim 1 further including solidifying said flowable magnetic material prior to inducing magnetization therein.

6. The process of claim 1 further including solidifying said flowable magnetic material after inducing magnetization therein.

7. The method of claim 1, wherein the step of inducing magnetization includes orienting the magnetization vector of the particles of at least one rare earth material toward a common orientation.

8. The method of claim 1, wherein said magnetization is not uniform throughout said flowable magnetic material, thereby forming precision rare-earth permanent magnets having a nonuniform magnetization therein.

9. A process for fabricating precision rare-earth permanent magnets, comprising the steps of:

a) lithographically constructing a mold for manufacturing precision components;

b) providing a flowable magnetic material comprising magnetized rare-earth magnetic particles, and filling said mold with said flowable magnetic material;

c) applying a magnetic field and aligning said magnetized rare earth magnetic particles; and d) solidifying said flowable magnetic material, thereby forming said precision rare-earth permanent magnets.

10. The process of claim 1 wherein the step of filling said mold includes a process selected from the group consisting of: calendering, pressing, injection molding, dipping, doctor blading, or hot pressing.

11. A process for manufacturing precision rare-earth permanent magnets, comprising the steps of:

a) constructing a negative mold;

b) forming a second mold from said negative mold for fabricating precision components;

c) filling said second mold with a flowable magnetic material comprising rare-earth magnetic particles; and d) applying a magnetic field and inducing a desired magnetization in said flowable magnetic material thereby forming said precision rare-earth permanent magnets.

12. The process of claim 11, wherein said negative mold comprises:

a) a substrate; and b) a structured layer formed thereon.

13. The process of claim 11, where the step of constructing a negative mold further includes coating one surface of the negative mold with a release layer.

14. The process of claim 11, further including depositing a metal layer within the structured layer of said negative mold to form said second mold of metal.

15. The process of claim 14, further including releasing said negative mold from said metal layer to form said second mold of metal.

16. The process of claim 12, further including depositing a ceramic precursor layer within the structured layer of said negative mold and sintering the ceramic precursor layer to form said second mold of ceramic.

17. The process of claim 11, wherein the magnetic material includes a binding material selected from the group consisting essentially of epoxy resins, low order polymers, or monomers.

18. The process of claim 16, further including releasing said negative mold from said sintered ceramic precursor layer to form said second mold of ceramic.

19. The process of claim 11 wherein the step of filling said second mold includes a process selected from the group consisting of: calendering, pressing, injection molding, or dipping.

20. A process for manufacturing precision rare-earth permanent magnets, comprising the steps of:

a) constructing a negative mold;

b) forming a second mold from said negative mold for fabricating precision components;

c) providing a flowable magnetic material comprising magnetized rare-earth magnetic particles, and filling said mold with said flowable magnetic material;

d) applying a magnetic field and aligning said magnetized rare-earth magnetic particles; and e) solidifying said flowable magnetic material, thereby forming said precision rare-earth permanent magnets.

21. The process of claim 11, wherein the step of inducing magnetization includes orienting the magnetization vector of the particles of at least one rare earth material toward a common orientation.

22. The process of claim 11, further including solidifying said flowable magnetic material prior to inducing magnetization.

23. The process of claim 11, further including solidifying said flowable magnetic material after inducing magnetization.

* * * * *